United States Patent [19]

Pierson

[11] Patent Number: 5,022,536

[45] Date of Patent: Jun. 11, 1991

[54] FIREARM LOCKING SYSTEM

[76] Inventor: William J. Pierson, 1517 Fairglen Rd., El Cajon, Calif. 92071

[21] Appl. No.: 461,971

[22] Filed: Jan. 8, 1990

[51] Int. Cl.[5] ..... A47F 7/00

[52] U.S. Cl. ..... 211/4; 211/4; 70/58

[58] Field of Search ..... 211/64, 4; 70/30, 49, 70/18, 58

[56] References Cited

U.S. PATENT DOCUMENTS 3,664,163 5/1972 Foote .
4,813,252 3/1989 Ray .
4,867,478 9/1989 Anderson .
4,951,577 8/1990 Bentley .

*Primary Examiner*—Blair M. Johnson
*Attorney, Agent, or Firm*—Charles C. Logan, II

[57] ABSTRACT

A locking system for firearms that allows the firearms to be openly displayed, yet safe from the hands of inquisitive children. The major components of the system are a cable assembly, a block shaped anchor housing and a pair of eyebolts. The cable assembly is a length of steel cable having a loop formed at its opposite ends along with a tubular clamp adjacent thereto. The tubular clamp and loops are detachably received in sockets formed in opposing side walls of the anchor housing. There is a cavity formed in the rear walls of the anchor housing which receives the two loops and also the closed loop end of the eyebolts. A locking pin passes down through an aperture in the top wall of the anchor housing and it threads through the respective loops and the closed loop ends of the eyebolts. A lock assembly extending through the top wall of the anchor housing is connected to a locking cam that detachably engages the locking pin to prevent its removal.

8 Claims, 2 Drawing Sheets

FIREARM LOCKING SYSTEM

BACKGROUND OF THE INVENTION

The invention relates to a locking system and more specifically for a system to secure firearms in a person's home or office so they can not be played with by children. In the past, there have been numerous occasions when children have taken a parent's firearm such as a revolver or rifle and while using or examining it have injured or killed another person. Many people keep revolvers in unlocked drawers and merely hope children will not find them and play with them. Other persons having rifles have been forced to purchase or build expensive gun racks or cabinets that require locks of some nature. Some of these cabinets have glass windows which leaves them open to the danger of having the glass broken in order to get into the cabinet and getting the weapon.

It is an object of the invention to provide a novel locking system for firearms that will safely secure rifles and revolvers in an open setting within a room of a house or office.

It is also an object of the invention to provide a novel locking system for firearms that allows them to be visually in view yet secure from curious hands of children.

It is another object of the invention to provide a novel locking system for firearms that is economical to manufacture and market.

It is a further object of the invention to provide a novel locking system for firearms that would make it extremely difficult for an adult to remove or steal a firearm unless they destroy a portion of the walls of the room adjacent to where the locking system is secured.

SUMMARY OF THE INVENTION

Applicant's novel locking system for firearms has been designed to prevent accidents to children. The prevention of a shooting accident by a child finding an unlocked revolver or rifle is the purpose of this system.

The locking system allows the owner to display his firearms openly in a room in his home or office without the need for an expensive closed cabinet for storing them. The novel locking system makes use of the structural integrity of the walls of a room, most especially the vertical studs that are located adjacent the corner of a room. A pair of eyebolts are screwed into the corner studs at a predetermined height above the base upon which the butt of the rifle would rest. The eyebolts would have a predetermined spacing from each other. The block shaped anchor housing is secured to the corner wall studs by screws that pass through bore holes in the anchor housing. The cavity at the rear of the anchor housing receives the closed loop ends of the eyebolts in a cavity formed therein.

The cable assembly is formed from a predetermined length of steel strand cable having a plastic sheet. Each of the ends of the cable has its end turned back upon it to form a loop and the free end is held in position by a tubular clamp. When used, the cable is threaded through the trigger guard of the rifles and revolvers and the loops are received in sockets formed in opposing front walls of the anchor housing.

A bore hole is formed in the top wall of the anchor housing and a locking pin is inserted downwardly therethrough. It passes into the cavity formed in the rear of the anchor housing and it also passes through the respective closed loop ends of the eyebolts and the loops at the end of the cable.

The top wall of the anchor housing has a bevel section with a bore hole formed therein. It is in communication with the cavity in the rear of the anchor housing and a key actuated lock assembly is received therein. The bottom end of the cylinder of the lock has a square shank that is inserted through a square aperture in a locking cam member. The locking cam has a horizontal finger portion whose cam surface engages an annular groove formed in the locking pin. A quarter turn of the key in the lock cylinder rotates the locking cam out of engagement with the locking pin, thus allowing its removal. When the locked cylinder is turned to its locked position, the locking pin cannot be removed. Attempts to pull on the upper portion of the locking pin will result in that portion detaching from the lower head portion. Thus the removal of firearms from the locking device can be prevented unless the person attempting to remove them has a large pair of wirecutters.

DESCRIPTION OF THE PREFERRED EMBODIMENT

Figure 1:
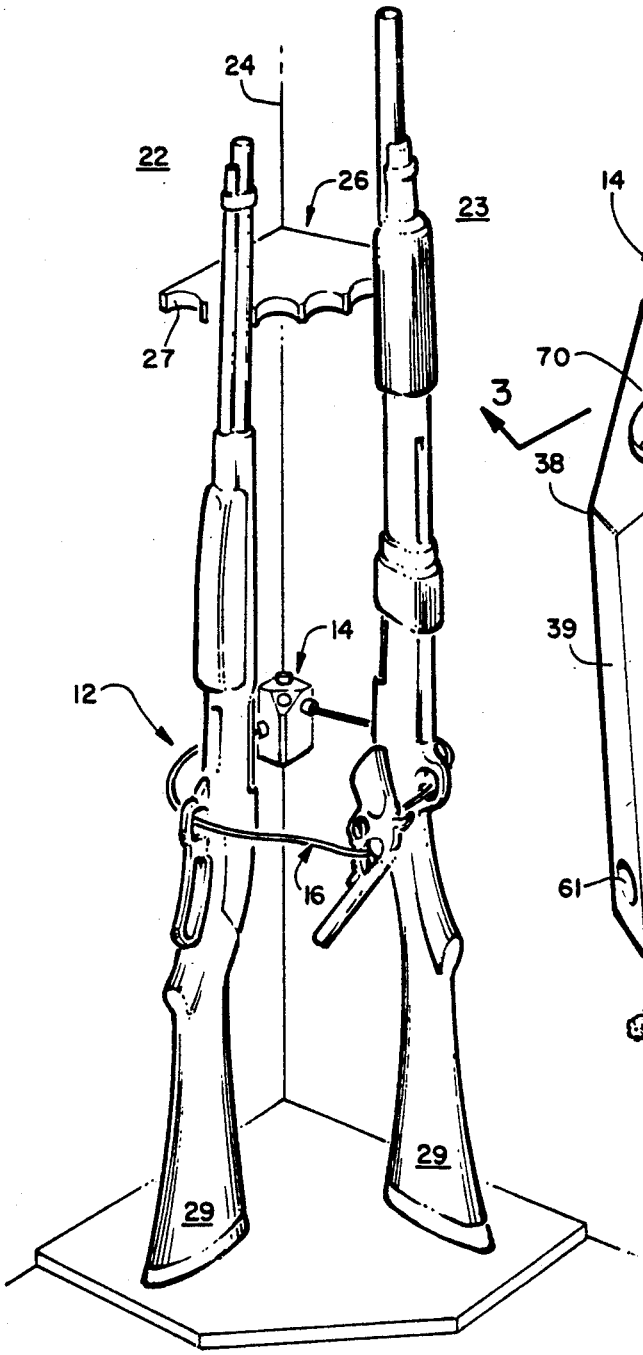
FIG. 1 is a perspective view illustrating applicant's novel locking system for firearms as it is positioned in a corner of a room.
Figure 2:
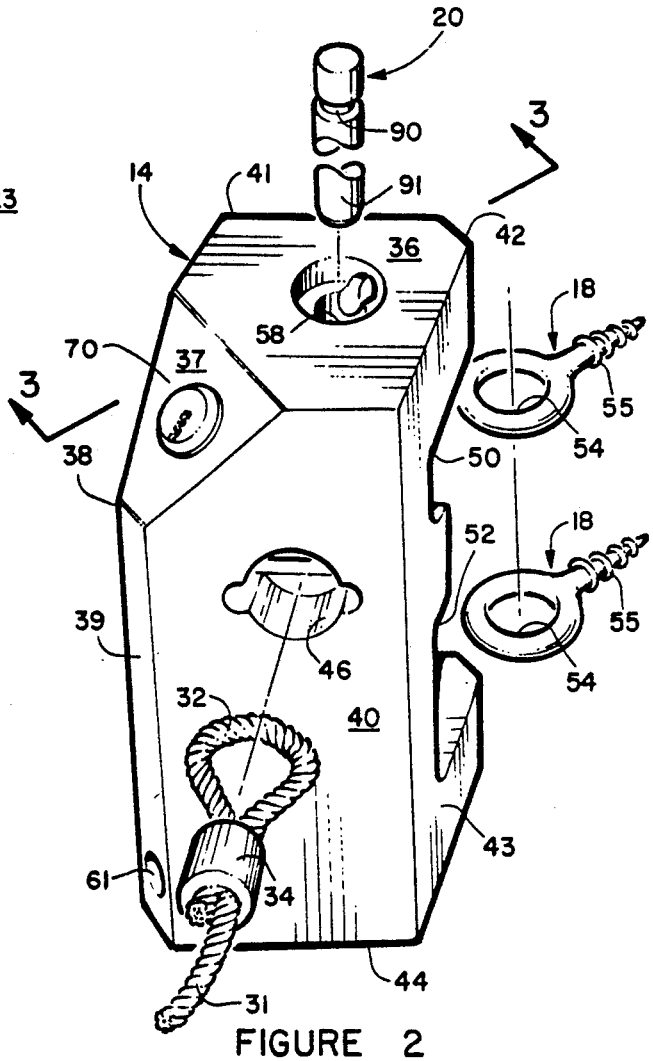
FIG. 2 is a perspective view of the block shaped anchor housing with mating components shown in exploded view.
Figure 3:
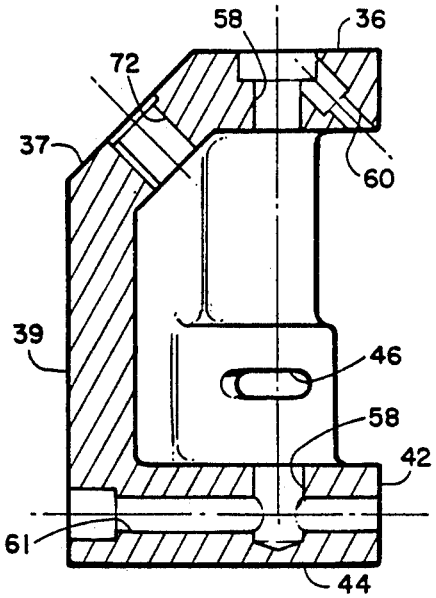
FIG. 3 is a cross sectional view taken along lines 3—3 of FIG. 2 with the lock assembly removed for clarity.
Figure 4:
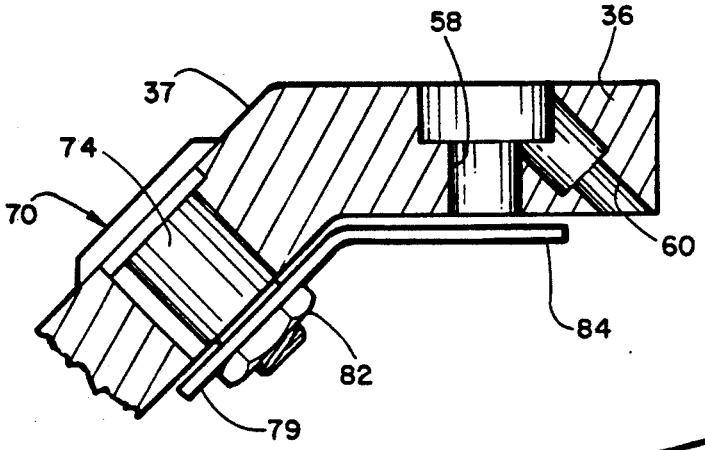
FIG. 4 is a partial cross sectional view showing the lock assembly in the top wall of the block shaped anchor housing.
Figure 5:
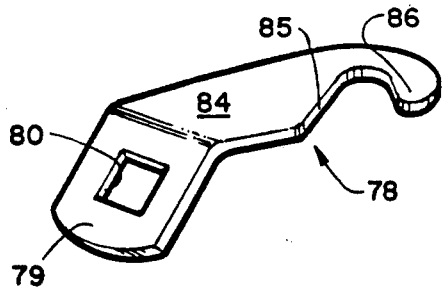
FIG. 5 is a perspective view of the locking cam.
Figure 6:
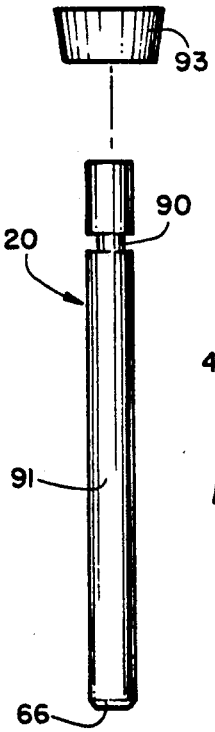
FIG. 6 is a side elevation view of the locking pin.
Figure 7:
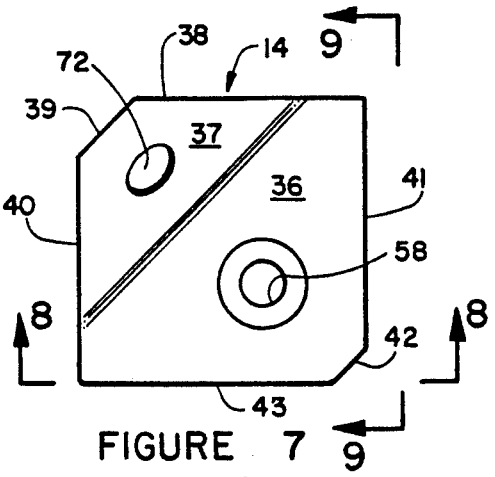
FIG. 7 is a top plan view of the block shaped anchor housing.
Figure 8:
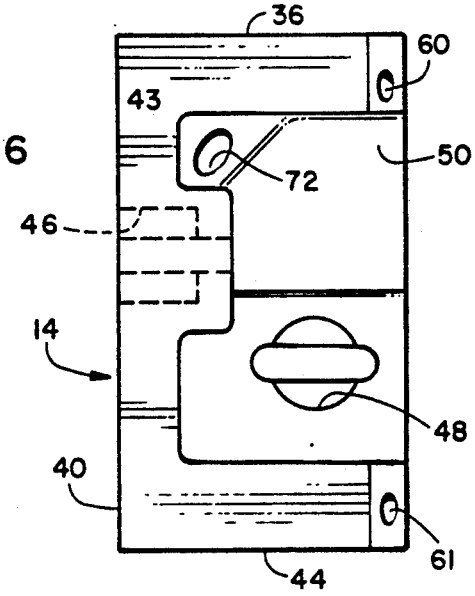
FIG. 8 is a side elevation view taken along lines 8—8 of FIG. 7.
Figure 9:
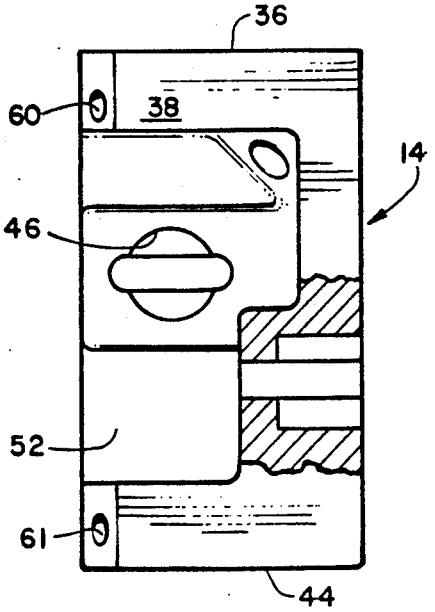
FIG. 9 is a side elevation view, with portions broken away taken along lines 9—9 of FIG. 7.

Applicant's novel firearm locking system will now be described by referring to FIGS. 1-9 of the drawings. The system is generally designated numeral 12. Its major components are a block shaped anchor housing 14, a cable assembly 16, a pair of eyebolts 18 and a locking pin 20.

Firearm locking system 12 is shown in FIG. 1 in the manner in which it is used. A room having a pair of walls 22 and 23 forms a corner 24. Block shaped anchor housing 14 is secured to the studs (not seen) that would be found behind the walls at the corner. Spaced upwardly a predetermined distance from lock shaped anchor housing 14 is a barrel loom 26 having a plurality of concave notches 27 in its front wall. Rifles 29 have their barrels rest in notches 27.

Cable assembly 16 has a loop 32 formed at each of its ends with a tubular clamp 34 adjacent thereto.

Block shaped anchor housing 14 has a top wall 36 having a bevel section 37. It also has a left front wall section 38, a center front wall section 39, a right front wall section 40, a left rear wall section 41, a central rear wall section 42, a right rear wall section 43 and a bottom wall 44. An upper wall socket 46 is formed in right front wall section 40 for receiving one of the loops 32 and its tubular clamp 34. A lower wall socket 48 is formed in left front wall section 38. The rear of block shaped anchor housing 14 has an upper cavity section 50 and a lower cavity section 52. Eyebolts 18 have a closed loop end 54 and a threaded shank 55. A locking pin bore hole 58 is formed in top wall 36 and it extends down into bottom wall 44. A screw fastener bore hole 60 is formed in top wall 36 and a screw fastener bore hole 61 is formed in bottom wall 44. Fastening screws can be inserted into these respective bore holes to secure the block shaped anchor housing to the corner of the room. Afterward the locking pin 20 is inserted downwardly through locking pin bore hole 58, closed loop end 54 of the upper eyebolt, loop 32 at one end of cable 31, loop 32 at the other end of cable 31, closed end loop 54 of the lower eyebolt and then the bottom end 66 of locking pin 20 is inserted into the bottom end of locking pin bore hole 58.

Lock assembly 70 is inserted into lock assembly bore hole 72 in bevel section 37. It is a key operated lock having a cylinder 74 having a square shank 75 adjacent its bottom end. Locking cam 78 has an inclined portion 79 having a square aperture 80. Square shank 75 mates with square aperture 80 and a locking nut 82 secures it in position. Locking cam 78 has a horizontal finger portion 84 having a cam surface 85 and a tip 86.

By turning a key in lock cylinder 74 a quarter of a turn, locking cam 78 is disengaged from the annular groove 90 on the shank 91 of locking pin 20. By turning the key in its reverse direction, locking cam 78 will prevent removal of locking pin 20, thus making the firearms secure from curious children.

Locking pin 20 has a two part head formed from a detachable upper head portion 93 that is glued or otherwise detachably connected on to a lower head portion 94. Attempts to pull the top of locking pin 20 will result in detachable upper head portion 93 detaching therefrom.

What is claimed is:

1. A firearm locking system comprising:

a first horizontally oriented eyebolt, said eyebolt having a closed loop and an externally threaded shank, said threaded shank for being detachably threaded into vertical wall studs located in the corner of a room;

a block shaped anchor housing having a top wall, a bottom wall, and a plurality of upright walls;

a cable assembly comprising a predetermined length of cable having a loop formed at both of its opposite ends;

an aperture formed in the top wall of said anchor housing for removably receiving a locking pin;

a cavity formed in at least one of the upright walls of said anchor housing and it is in communication with said locking pin aperture, an upper socket and a lower socket;

said upper socket being formed in one of the upright walls of said block shaped anchor housing for removably receiving one of the loops formed at the end of said cable;

said lower socket being formed in another of the upright walls of said block shaped anchor housing for removably receiving one of the loops formed at the end of said cable;

a vertically oriented locking pin having a top end and a bottom end, the bottom end of said locking pin being removably inserted into the closed loop end of said eyebolt and also the loops on the end of said cable; and means for locking said locking pin in said block shaped anchor housing.

2. A firearm locking system as recited in claim 1 further comprising a second horizontally oriented eyebolt, said eyebolt having a closed loop end and an externally threaded shank said threaded shank being detachably threaded into vertical wall studs located in the corner of a room, said second horizontally oriented eyebolt being spaced a predetermined height below said first horizontally oriented eyebolt.

3. A firearm locking system as recited in claim 1 wherein said block shaped housing is made of plastic material.

4. A firearm locking system as recited in claim 1 wherein said block shaped housing is made of metal material.

5. A firearm locking system as recited in claim 1 wherein said cable has a tubular clamp positioned adjacent each of its loops.

6. A firearm locking system as recited in claim 1 wherein said means for locking said locking pin comprises:

a lock assembly;

an aperture in the top wall of said block shaped anchor housing for removably receiving said lock assembly;

a locking cam detachably connected to said lock assembly; and means on said locking pin to be releasably engaged by said locking cam.

7. A firearm locking system as recited in claim 1 wherein said means on said locking pin to be releasably engaged by said locking cam is an annular groove positioned intermediate its length.

8. A firearm locking system as recited in claim 1 further comprising at least one screw fastener bore hole in said block shaped anchor housing.

* * * * *